US008297368B2

(12) United States Patent
Corbett et al.

(10) Patent No.: US 8,297,368 B2
(45) Date of Patent: Oct. 30, 2012

(54) SYSTEMS AND METHODS FOR INITIATING ANNULAR OBSTRUCTION IN A SUBSURFACE WELL

(75) Inventors: Thomas G. Corbett, Willis, TX (US); Larry J. Chrusch, Calgary (CA); Jackie C. Sims, Houston, TX (US); Krystian K. Maskos, Houston, TX (US); Luis C. Bianco, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 188 days.

(21) Appl. No.: 12/607,712

(22) Filed: Oct. 28, 2009

(65) Prior Publication Data

US 2011/0094756 A1 Apr. 28, 2011

(51) Int. Cl.
*E21B 33/12* (2006.01)

(52) U.S. Cl. ..... 166/387; 166/179

(58) Field of Classification Search ..... 166/387, 166/179, 118

See application file for complete search history.

(56) References Cited

U.S. PATENT DOCUMENTS

| | | | | |
|---|---|---|---|---|
| 3,072,189 | A | 1/1963 | MacSporran | |
| 4,099,563 | A | 7/1978 | Hutchison et al. | |
| 4,942,925 | A | 7/1990 | Themig | |
| 6,564,870 | B1 | 5/2003 | Grigsby et al. | |
| 2003/0075341 | A1 | 4/2003 | Kurlenya et al. | |
| 2004/0055758 | A1 | 3/2004 | Brezinski et al. | |
| 2006/0090903 | A1 | 5/2006 | Gano et al. | |
| 2007/0267201 | A1 * | 11/2007 | Brezinski et al. | 166/387 |
| 2009/0205833 | A1 | 8/2009 | Franz et al. | |
| 2011/0094755 | A1 * | 4/2011 | Corbett et al. | 166/387 |

OTHER PUBLICATIONS

International Search Report for International Patent Application No. PCT/US2010/052995 dated Jun. 20, 2011, 4 pages.

* cited by examiner

*Primary Examiner* — William P Neuder
(74) *Attorney, Agent, or Firm* — Edward Mickelson; John E. Vick

(57) ABSTRACT

The present invention is directed to systems and methods for initiating annular obstructions in wells used in, or in support of, enhanced oil recovery operations—particularly enhanced oil recovery (EOR) efforts involving steam injection (e.g., steam flooding). In at least some instances, system and method embodiments of the present invention utilize one or more passively-activated annular obstruction devices (and/or hybrid active/passive devices) for inducing annular obstruction, wherein the associated passive or hybrid activation is at least partially controlled by thermal means such that it can be deemed to be thermally-directed or thermally-controlled. Such thermally-directed passive activation can afford considerably more control over the annular obstruction process and, correspondingly, over the overall steam injection into the formation and associated reservoir—thereby providing more efficient recovery of hydrocarbons.

25 Claims, 4 Drawing Sheets

SYSTEMS AND METHODS FOR INITIATING ANNULAR OBSTRUCTION IN A SUBSURFACE WELL

FIELD OF THE INVENTION

This invention relates generally to oilfield drilling and completion operations, and specifically to systems and methods for initiating annular obstructions in wells used in, or in support of, such operations—particularly enhanced oil recovery operations such as those that involve steam flooding.

BACKGROUND

Steam flooding is a common method for producing oil from reservoirs that would otherwise be difficult to produce from using conventional resources. This type of enhanced oil recovery (EOR) technique typically utilizes a plurality of steam injection wells interspersed with production wells. See, e.g., Hutchison et al., U.S. Pat. No. 4,099,563, issued Jul. 11, 1978; and Shu, U.S. Pat. No. 4,431,056, issued Feb. 14, 1984.

Steam injection wells are often partially cased down close to the region in which steam is to be injected. The region of the well where steam is to be injected, however, must remain open to the formation comprising the target reservoir. In this region, a liner string is typically run some distance (e.g., several hundred to several thousand meters), with slots, holes, or other porous channels permitting fluid communication with the formation along at least portions of the length of liner string. See, e.g., Themig, U.S. Pat. No. 4,942,925, issued Jul. 24, 1990.

Ideally, during steam injection, an even flux of fluid to the reservoir is maintained. In practice, however, unrestricted flow in the annulus, complicated by reservoir heterogeneities and/or varying reservoir pressures, results in an uneven flow of fluid to the reservoir. In turn, this uneven flux or flow of fluid to the formation reduces overall hydrocarbon extraction yields from the reservoir.

A number of devices are currently employed in the industry to ensure a fairly even flux of fluid out of the liner and into the formation. Such devices generally induce an annular obstruction (i.e., a barrier) within the annular region (see, e.g., Grigsby et al., U.S. Pat. No. 6,564,870, issued May 20, 2003). In some instances, such devices are actively deployed such that specific actions are taken to actuate and/or activate the obstruction (e.g., hydraulic and/or mechanical actuation). The downside to such devices, and their method of deployment, is the need to run mechanical and/or hydraulic actuation means downhole.

In other instances, the activation of such above-mentioned devices is passive—requiring no direct external intervention, e.g., a "swell packer" that comprises a mandrel wrapped in an elastomeric material, wherein the elastomeric material swells in the presence of a particular fluid that is introduced into the annular region.

In view of the foregoing, an improved method and/or system for passively obstructing the annular region (or a passive obstruction comprising active elements, e.g., a hybrid obstruction) in a steam injection well would be extremely useful—particularly wherein such a method and/or system provides better control over the actuation process without having to run tools or devices downhole to mechanically and/or hydraulically actuate an annular obstruction packer.

BRIEF DESCRIPTION OF THE INVENTION

The present invention is directed to systems and methods for initiating annular obstructions in wells used in, or in support of, enhanced oil recovery operations—particularly enhanced oil recovery (EOR) efforts involving steam injection (e.g., steam flooding). In at least some instances, system and method embodiments of the present invention utilize one or more passively-activated annular obstruction devices (and/or hybrid active/passive devices) for inducing annular obstruction, wherein the associated passive or hybrid activation is at least partially controlled by thermal means such that it can be deemed to be thermally-directed or thermally-controlled. Such thermally-directed passive activation can afford considerably more control over the annular obstruction process and, correspondingly, over the overall steam injection into the formation and associated reservoir—thereby providing more efficient recovery of hydrocarbons.

In some embodiments, the present invention is directed to one or more systems of a first type for initiating annular obstruction in a subsurface (e.g., steam injection) well, such one or more systems of a first type generally comprising: (a) an at least partially permeable liner string situated within a portion of a wellbore that is at least partially open to a hydrocarbon-bearing formation; (b) a sealed metal chamber disposed about a portion of the at least partially permeable liner string; (c) a material contained within the sealed metal chamber, wherein said material is initially in a condensed state, but which transitions to a gaseous state when heated above a certain threshold temperature; and (d) a means of heating the material contained within the metal chamber so as to effect its transition to the gaseous state where, upon transitioning to a gas, the material increases the pressure within the chamber, and where, upon experiencing a pressure increase, the metal chamber expands in such a way as to engage the formation, thereby forming an annular obstruction between the at least partially permeable liner string and the formation. Such system embodiments of a first type can be seen as comprising a chamber-based annular obstruction device (or means), i.e., that part of the partially permeable liner string that is functionally operable for engaging the formation wall and effecting annular obstruction in at least a region of the wellbore annulus.

In some embodiments, the present invention is directed to one or more methods of a first type for initiating annular obstruction in a subsurface (e.g., steam injection) well, such one or more methods of a first type generally comprising the steps of: (a) fabricating a modified length of at least partially permeable liner string, the modified length comprising: (i) a sealed metal chamber disposed about the modified length of at least partially permeable liner string; and (ii) a material situated inside the sealed metal chamber, wherein said material is initially in a condensed state and which transitions to a gas when heated above a certain threshold temperature; (b) positioning the modified length of at least partially permeable liner string in an at least partially open hole region of a wellbore, wherein an annular region is established between the modified length of permeable liner string and the open hole region of the wellbore; and (c) heating the modified length of liner string so as to effect a transition of the material contained therein from a condensed state to a gaseous state, where upon transitioning to a gas, the material increases the pressure within the sealed metal chamber, and where upon experiencing a pressure increase the sealed metal chamber expands in such a way as to engage the formation, thereby forming an annular obstruction between the modified length of liner string and the formation. In a manner analogous to the corresponding systems (of a first type) mentioned above, the modified length of partially permeable liner string can be seen to comprise a chamber-based annular obstruction device.

In some embodiments, the present invention is directed to one or more systems of a second type for initiating annular obstruction in a subsurface well, each of said one or more systems generally comprising: (a) an at least partially permeable liner string situated within a portion of a wellbore that is at least partially open to a hydrocarbon-bearing formation; (b) a load-bearing coiled spring disposed about a portion of the at least partially permeable liner string, wherein the load-bearing coiled spring is in a load-bearing state selected from the group consisting of a tensioned state and a compressed state; (c) a spring retainer device attached to the load-bearing coiled spring so as to maintain it in a load-bearing state, wherein the spring retainer device is at least partially fabricated of material designed to melt above a predetermined temperature, and wherein upon melting loses its ability to maintain the coiled spring in a load-bearing state; and (d) metal mesh functionally-associated (e.g., interposed) with the load-bearing spring such that removal of the load from the spring causes the metal mesh to engage the formation, thereby forming an annular obstruction between the liner string and the formation, wherein the load removal is effected by application of heat to the annular region sufficient to melt at least a portion of the spring retainer device. Such systems of a second type can be seen as comprising a coiled spring-based annular obstruction device or means, wherein such a device is comprised of a load-bearing coiled spring, metal mesh, and retainer pin(s), that collectively function to engage the formation (thereby inducing obstruction) when actuated.

In some embodiments, the present invention is directed to one or more methods of a second type for initiating annular obstruction in a subsurface well, said methods generally comprising the steps of: (a) fabricating an at least partially permeable length of modified liner string, the length of modified liner string comprising: (i) a load-bearing coiled spring disposed about at least a portion of the modified liner string, wherein the load-bearing coiled spring is in a load-bearing state selected from the group consisting of a tensioned state and a compressed state; (ii) a spring retainer device attached to the load-bearing coiled spring so as to maintain it in the load-bearing state, wherein the spring retainer device is at least partially fabricated of material designed to melt above a predetermined temperature, and wherein upon melting loses its ability to maintain the coiled spring in a load-bearing state; and (iii) metal mesh functionally-associated with the load-bearing coiled spring such that when the coiled spring undergoes a transformation from a load-bearing state to a non-load-bearing state, the metal mesh expands outward in a radial direction; (b) positioning the at least partially permeable length of modified liner string in an open hole region of a wellbore, wherein an annular region is established between the modified length of liner string and the open hole region of the wellbore; and (c) heating the modified length of liner string so as to melt the spring retainer device and effect the transformation of the coiled spring to the non-load-bearing state, correspondingly causing the metal mesh to expand outwardly and engage the formation, thereby forming an annular obstruction between the modified length of liner string and the open hole. In a manner analogous to the corresponding systems (of a second type) mentioned above, the modified length of partially permeable liner string can be seen to comprise a coiled spring-based annular obstruction device.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF THE INVENTION

1. Introduction

This invention is directed to systems and methods for initiating annular obstructions in wells used in, or in support of, enhanced oil recovery operations—particularly enhanced oil recovery involving steam flooding. In at least some instances, system and method embodiments of the present invention utilize one or more passively-activated devices (or means) for inducing annular obstruction, wherein the associated passive activation is thermally-directed. In contrast to the passive activation devices and techniques referred to in the background section (vide supra), such thermally-directed passive activation can afford considerably more control over the annular obstruction process and, correspondingly, over the overall steam injection into the formation and associated reservoir.

Mechanisms by which the systems and methods of the present invention thermally-direct such passive actuation of annular obstruction will be elaborated on more fully below. In a general sense, however, all of such systems and methods rely on one or more thermally-activated obstructive devices. The relation of such devices to other components of a steam-injection well are illustrated, in exemplary fashion, in FIG. 1, wherein the well is depicted as a deviated well, but this need not be the case in every situation.

Figure 1:
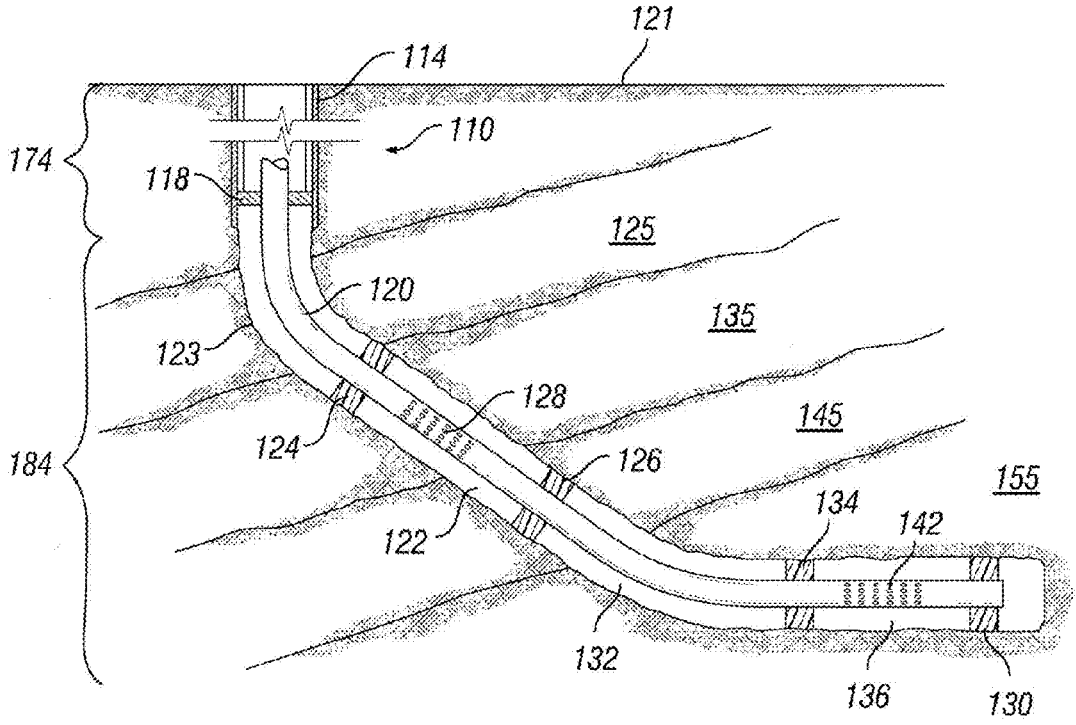
FIG. 1 is an illustrative overview of how systems of the present invention can be configured, wherein the number and placement of the individual components of such systems is meant merely to be illustrative, not limiting.

With reference now to FIG. 1, in a subsurface well 110 extending down from surface 121, an open hole region 184 extends from a cased region 174, wherein the cased region in established by casing string 114 that is typically cemented in place. Within the well, a liner string 120 extends from the cased region into, and largely through, the open hole region, wherein the liner string 120 is (typically) functionally connected to the casing string 114 via the use of a liner hanger or packer 118 (or, generally, one or more annular obstruction devices). Along portions of the length of liner string 120 (comprised of numerous segments of liner joints) are one or more regions of pores (e.g., 128 and 142) from which fluid (e.g., steam) can emanate, filling the annular regions 122 and 136 established between the liner string 120 and the formation wall 123, and accessing reservoirs contained within regions 135 and 155 of the surrounding formation. By careful placement and passive actuation of annular obstruction-inducing devices 124, 126, 130, and 134 (shown in the expanded state), the flow of steam (or other fluid) to the formation can be carefully controlled. Note that the number and relative placement of the devices is meant merely to be illustrative, and not meant to limit the scope of the invention.

In some embodiments or instances, the means or devices for inducing annular obstruction can (e.g., as part of, or used in, systems and methods of the present invention) generally fall into one of two categories depending upon the type of mechanism and/or operation they employ. In some instances, the mechanism and/or operation is based on a temperature-actuated expanding metal chamber (e.g., systems and methods of a first type). In other instances, the mechanism and/or operation is based on a load-bearing coiled spring (e.g., systems and methods of a second type).

With regard to the active/passive nature of actuation/activation mentioned above, in some such above-described embodiments the mechanisms and/or means by which the systems and/or methods operate to induce annular obstructions can be deemed to be hybrid mechanisms and/or means by which thermal direction (vide supra) can afford some measure of active activation or actuation.

2. Definitions

Certain terms are defined throughout this description as they are first used, while certain other terms used in this description are defined below:

A "liner string," as defined herein, is similar to a casing string in that it is made up of joints (pipe segments threaded on each end), but it is not run to the well surface as a casing string is. Instead, a liner string is suspended by a liner hanger attached to the casing above it. For open-hole wells, the liner string is not cemented and is in fluid communication with the formation.

An "open-hole well," as defined herein, is a well in which liner string is in direct fluid communication with the formation. Often, such wells are cased (and cemented) down to the source/reservoir rock.

An "annulus," as defined herein, refers to the volume or void space between two essentially cylindrical objects. As an example, in an open hole wellbore, the space between the liner string and formation wall is deemed an annulus.

An "annular region," as defined herein, refers to a portion of an annulus, wherein such a portion can be physically or conceptually isolated from the remainder of the annulus of which it is a part.

The term "annular obstruction," as defined and used herein, refers to fluid-flow restriction in one or more (annular) regions of a wellbore annulus.

The term "active actuation," as defined herein, describes the process by which a device is actively actuated or activated by direct application of some form of hydromechanical work.

The term "passive actuation," as defined herein, describes the process by which a device is actuated by its passive exposure to an environmental condition.

The term, "hybrid actuation," as defined herein, describes the process by which a device is actuated by an environmental condition that is actively or deliberately altered.

"Steam injection," as defined herein, is the injection of surface-generated steam into a subsurface formation, typically to aid the recovery of hydrocarbonaceous assets therein.

"Steam flooding," as defined herein, is an enhanced oil recovery (EOR) technique that employs steam injection to render oil more amenable to flow (out of the reservoir). Typically, this involves multiple steam injection wells to be employed simultaneously.

3. Systems of a First Type

As mentioned previously herein (vide supra), systems and methods of the present invention, for initiating annular obstruction in subsurface wells, can be broadly categorized into one of two types—depending on the type of mechanism by which annular obstruction is actuated or otherwise initiated. The discussion that follows, within this section, is directed at systems (i.e., systems of a first type) that employ a mechanism that is based, in large part, on the expansion of a sealed metal chamber. Such systems can be seen to comprise one or more chamber-based annular obstruction devices (vide infra).

Figure 2A:
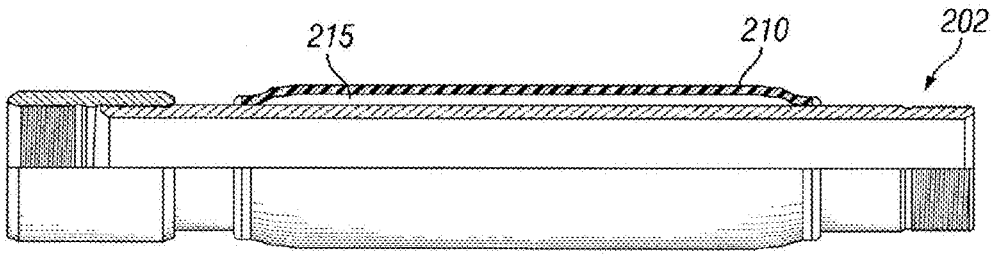
FIG. 2A depicts a sealed metal chamber, in its unexpanded state, disposed about a portion of a liner joint, where the chamber is constructed so as to be an integral part of the liner joint, in accordance with some embodiments of the present invention.
Figure 2B:
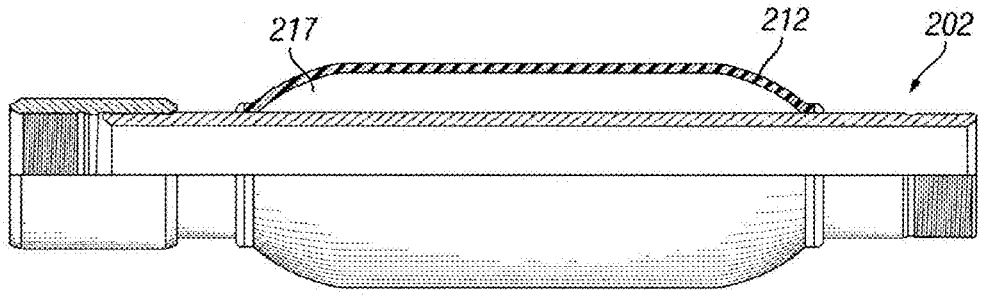
FIG. 2B depicts the sealed metal chamber of FIG. 2A, but in its expanded state, as a result of the material contained within transitioning from a condensed state to a gaseous state, in accordance with some embodiments of the present invention.

With reference to FIGS. 2A and 2B, and with continued reference to FIG. 1 (for exemplary system component correlation), in some embodiments, the present invention is directed to a system (or systems) for initiating annular obstruction in a subsurface well 110, said system comprising: (a) an at least partially permeable liner string 120 situated within a portion of a wellbore (of subsurface well 110) that is at least partially open to a hydrocarbon-bearing formation (e.g., region 184); (b) a sealed metal chamber (e.g., as in 210 and/or 310) disposed about a portion of the at least partially permeable liner string 120; (c) a material contained within the sealed metal chamber, wherein said material is initially in a condensed state (e.g., 215 and/or 315), but which transitions to a gaseous state (e.g., 217 and/or 317) when heated above a certain threshold temperature; and (d) a means of heating the material contained within the metal chamber so as to effect its transition to the gaseous state where, upon transitioning to a gas, the material increases the pressure within the chamber, and where, upon experiencing a pressure increase, the metal chamber expands in such a way as to engage the formation, thereby forming an annular obstruction (e.g., 124, 126, 130, 134) between the at least partially permeable liner string 120 and the formation (i.e., formation wall 123).

In some such above-described system embodiments, the subsurface well 110 is a steam injection well. While such systems are directed to generating annular obstruction/isolation in subsurface wells in general, steam injection is an economical and efficient method for additionally serving (in addition to its primary enhanced oil recovery purpose) as a means of heating, capable of effecting the transition of the material contained within the sealed metal chamber from a condensed state (e.g., material 215 and/or 315) to a gaseous state (e.g., material 217 and/or 317) (vide infra).

In some such above-described system embodiments, the well 110 is a deviated well, or at least includes sections that deviate from a vertical orientation (relative to the surface). The well of FIG. 1, i.e., subsurface well 110, is depicted as a deviated well, wherein a significant portion of the open hole region of the well runs in a substantially horizontal (e.g., greater than 45° deviation from vertical) direction through much of the formation.

In some such above-described system embodiments, the at least partially permeable liner string comprises pores or openings of a type selected from the group consisting of pre-drilled holes, slots, screens, and combinations thereof. In FIG. 1, exemplary liner string 120 comprises pores 128, 142 depicted as pre-drilled holes.

In some such above-described system embodiments, the sealed metal chamber is an integral part of the liner pipe (e.g., segment or joint of liner string 120) making up at least part of the at least partially permeable liner string. System embodiments such as these are depicted in FIGS. 2A and 2B, wherein it can be seen that the exterior wall of the liner joint 202 forms part of the sealed metal chamber 210. As a consequence, the material inside the chamber is in direct contact with the outer wall of the liner string. Those of skill in the art will recognize that numerous methods exist for forming such a sealed metal chamber that is an integral part of the liner pipe, wherein such methods can include welding techniques.

Figure 3A:
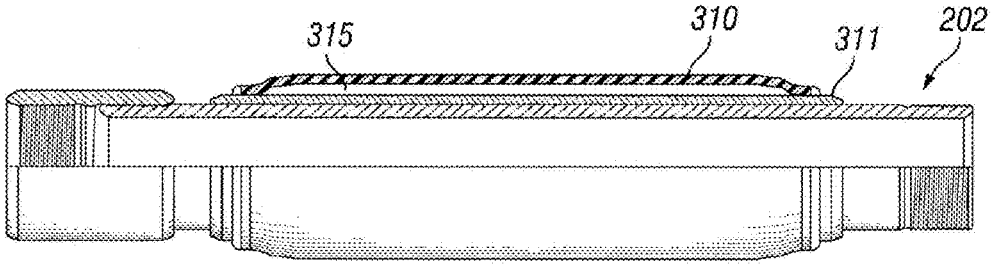
FIG. 3A depicts a sealed metal chamber, in its unexpanded state, disposed about a portion of a liner joint in a manner such that it is not an integral part of the liner joint, in accordance with some embodiments of the present invention.
Figure 3B:
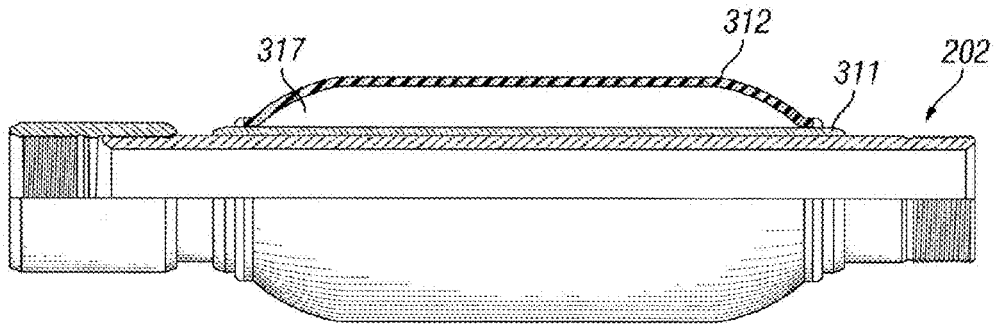
FIG. 3B depicts the sealed metal chamber of FIG. 3A, but in its expanded state, as a result of the material contained within transitioning from a condensed state to a gaseous state, in accordance with some embodiments of the present invention.

In some such above-described system embodiments, the sealed metal chamber is an attachment affixed to the at least partially permeable liner string. System embodiments such as these are depicted in FIGS. 3A and 3B, wherein it is seen that the sealed metal chamber 310 comprises its own wall 311 that shields the liner pipe 202 from the material (315, 317) contained within the sealed metal chamber. Similar to the embodiments above (i.e., those depicted in FIGS. 2A and 2B), chamber element 311 can be welded or otherwise affixed to the rest of sealed metal chamber 310. Sealed metal chamber 310 can be slid onto the liner pipe 202 before the pipe is deployed in the well, and the sealed metal chamber can be welded, affixed, or made to otherwise adhere to the liner pipe 202 by one or more of a variety of techniques known to those of skill in the art.

In some such above-described system embodiments, the sealed metal chamber (210, 310) has a geometry configured to enhance its ability to engage the formation (i.e., wall 123) upon expanding. Such enhanced geometrical configurations can take a variety of forms including, but not limited to, corrugations, ridges, undulations, and the like. Generally, however, such geometrical configuration enhancements are designed to permit better engagement of the formation wall upon expansion.

In some such above-described system embodiments, the above mentioned sealed metal chamber (210, 310) comprises at least one relief valve designed to vent below the burst pressure of said chamber. Such relief valves are known in the art in terms of their form and function, and it is within the purview of those skilled in the art to functionally integrate one or more of such valves into the design of one or more of the above-mentioned sealed metal chambers.

In some such above-described system embodiments, the sealed metal chamber (210, 310) typically comprises a volume, in the unexpanded state, of from at least about 50 cubic inches (0.8 L) to at most about 1,200 cubic inches (19.7 L). In some other such above-described system embodiments, the sealed metal chamber typically comprises a volume, in the unexpanded state, of from at least about 800 cubic inches (13.1 L) to at most about 3,000 cubic inches (49.2 L). In some still other such above-described system embodiments, the sealed metal chamber typically comprise a volume, in the unexpanded state, of from at least about 2,800 cubic inches (45.9 L) to at most about 12,000 cubic inches (196.7 L).

In some such above-described system embodiments, the material (e.g., 215, 315) inside the sealed metal chamber, upon transitioning to a gaseous state (e.g., 217, 317), increases the volume of the sealed metal chamber (e.g., the chamber transitioning from 210 to 212 and/or 310 to 312) typically by at least about 50 percent; in some or other such embodiments, typically by at least 100 percent; and in some or still other embodiments, typically by at least 200 percent. Upper limits on such expansion are typically about 300 percent.

Depending on the embodiment, the material (e.g., 215, 315) inside the sealed metal chamber can be placed inside the chamber during the chamber manufacture, or afterwards via a valve or other re-sealable access port. In some such above-described system embodiments, the material inside the sealed metal chamber is, in its condensed state, in a form selected from the group consisting of liquid, solid, and any mixture thereof. In some such system embodiments, the material inside the sealed metal chamber is selected from the group consisting of water, alcohols, glycols, glycerin, phase change materials (PCMs), eutectics, and combinations thereof. Note that in some embodiments, in instances where the condensed material is a solid, the solid can undergo a direct transition to the gaseous state (i.e., sublimation, upon being heated).

In some such above-described system embodiments (of a first type), such systems can be seen as comprising a chamber-based annular obstruction device/means (or a plurality thereof), i.e., that part of the partially permeable liner string that is functionally operable for engaging the formation wall and effecting annular obstruction in at least a region of the wellbore annulus. Such a device or means would correspond, in exemplary fashion, with one or more of annular obstruction devices 124, 126, 130, and 134, as depicted in FIG. 1.

In some such above-described system embodiments, the annular obstruction reduces flow in the annulus by at least about 20 percent to at most about 100 percent. In some other such embodiments, the annular obstruction reduces flow in the annulus by at least about 20 percent to at most about 90 percent. In some or still other embodiments, the annular obstruction reduces flow in the annulus by at least about 40 percent to at most about 90 percent.

In some such above-described system embodiments, the means of heating the condensed material comprises introduction of a downhole heat source; i.e., the thermal energy needed to effect the phase transition of the (initially) condensed material inside the sealed metal chamber is generated in the well, below the surface. Downhole heat sources are known in the art and include, but are not limited to, downhole resistive heaters, microwave heaters, and chemical (e.g., exothermic) reactions. See, e.g., MacSporran, U.S. Pat. No. 3,072,189, issued Jan. 8, 1963.

In some such above-described system embodiments, the means of heating involves injection of a heated fluid into the well, i.e., heating a fluid at the surface and then injecting it into the well. In some such embodiments, the means of heating the condensed material involves the injection of steam into the well. Means of heating suitable such fluids at the surface are known in the art, as are methods of introducing such a heated fluid into a wellbore. Means also exist for additionally or alternatively heating the fluid downhole. Regardless of whether the heating is carried out at the surface or downhole, in some embodiments, the means of heating the condensed fluid makes use of an exothermic chemical reaction.

In some such above-described system embodiments, such systems further comprise one or more additional sealed metal chambers filled with the condensed material, so as to effect multiple annular obstructions in the wellbore. Such an embodiment may be seen to be illustrated in FIG. 1, wherein four such annular obstruction devices (i.e., chamber-based devices comprising sealed metal chambers) are depicted in the figure as devices 124, 126, 130, and 134.

4. Methods of a First Type

Method embodiments (of a first type) described in this section generally correspond in a substantial manner with the system embodiments (of a first type) described above in Section 3. Accordingly, reference will continue to be made, in exemplary fashion, to FIGS. 1, 2A, 2B, 3A, and 3B, as many of the details are common to both the system and method embodiments.

Figure 4:
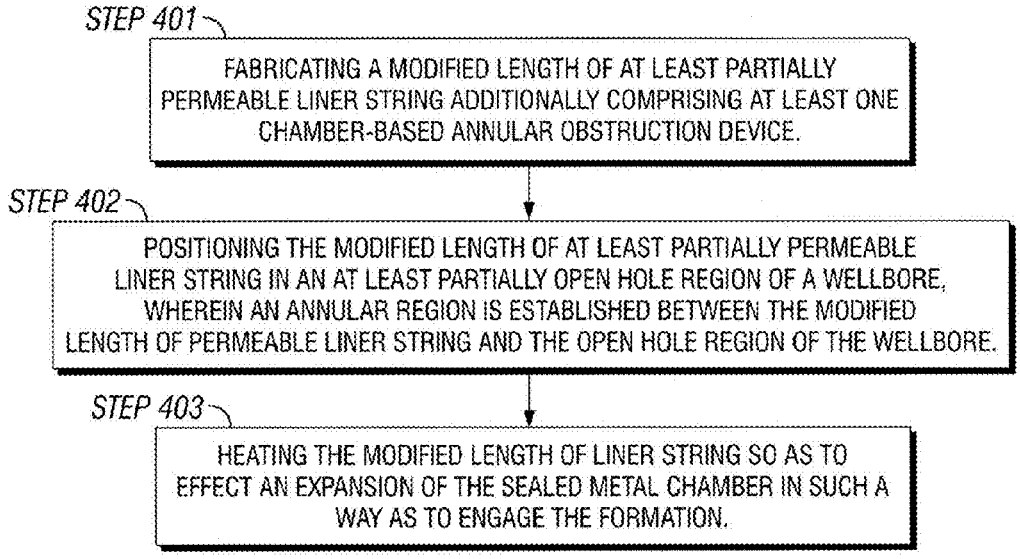
FIG. 4 outlines, in flow diagram form, methods of a first type for initiating annular obstruction in a subsurface well, in accordance with some embodiments of the present invention.

Referring now to FIG. 4, in some embodiments the present invention is directed to one or more methods for initiating annular obstruction in a subsurface well, said method(s) comprising the steps of: (Step 401) fabricating a modified length of at least partially permeable liner string, the modified length comprising: (i) a sealed metal chamber disposed about the modified length of at least partially permeable liner string; and (ii) a material situated inside the sealed metal chamber, wherein said material is initially in a condensed state and which transitions to a gas when heated above a certain threshold temperature; (Step 402) positioning the modified length of at least partially permeable liner string in an at least partially open hole region of a wellbore, wherein an annular region is established between the modified length of permeable liner string and the open hole region of the wellbore; and (Step 403) heating the modified length of liner string so as to effect a transition of the material contained therein from a condensed state to a gaseous state, where upon transitioning to a gas, the material increases the pressure within the sealed metal chamber, and where upon experiencing a pressure increase the sealed metal chamber expands in such a way as to engage the formation, thereby forming an annular obstruction between the modified length of liner string and the formation.

Like the system embodiments (of a first type) described above, the functional components described above in relation to the system embodiments, being operable for engaging the formation and inducing annular obstruction, can be deemed (at least in some embodiments) to be chamber-based annular obstruction devices (vide supra).

As in the case of the analogous system embodiment described above, in some such above-described method embodiments, the subsurface well is a steam injection well. In some such embodiments, the steam injected into the subsurface (in an effort to enhance oil recovery) can further serve as a means by which the modified length of liner string can be heated so as to effect a transition of the material contained therein from a condensed state to a gaseous state (vide infra).

Corresponding to the analogous system embodiments above, in some such above-described method embodiments, the subsurface well is a deviated well. Generally speaking, a well is deemed to be "deviated" if a substantial part of the wellbore deviates from a vertical axis established with the surface. Note that such deviation is typically intentional (e.g., directional drilling); and while some such subsurface wells so formed are largely horizontal (common for steam injection wells), the wells used in conjunction with at least some methods and/or system embodiments of the present invention are not required to be of the deviated variety.

In some such above-described method embodiments, and in at least some measure of correspondency with the analogous system embodiments (of a first type) described above, the at least partially permeable liner string comprises pores (openings, orifices) of a type selected from the group consisting of pre-drilled holes, slots, screens, and combinations thereof. Characteristics and variation among such pores is as described above in the analogous system embodiments.

In a manner similar to that described for the system embodiments (of a first type) in Section 3 above, the sealed metal chamber can be either an integral part of the modified length of liner pipe making up the at least partially permeable liner string (e.g., as in FIGS. 2A and 2B), or it can be an attachment affixed to the at least partially permeable liner string (e.g., as in FIGS. 3A and 3B).

In analogous correspondence to one or more of the system embodiments (of a first type) described above, in some such above-described method embodiments, the sealed metal chamber has a geometry configured so as to enhance its ability to engage the formation upon expanding. Accordingly, in some such embodiments, efficient expansion is designed and/or engineered into the sealed metal chamber by way of its geometry and/or associated geometrical features.

In some such above-described method embodiments, the sealed metal chamber comprises at least one relief valve designed to vent below the burst pressure of said chamber. In some such embodiments, while perhaps serving in a rupture-prevention capacity, such relief valves may additionally or alternatively be designed to vent in such a way as to control the pressure and fluid flow in the annular region.

As in the case of some such analogous system embodiments, in some such above-described method embodiments, the sealed metal chamber comprises a volume, in the unexpanded state, of from at least about 50 cubic inches (0.8 L) to at most about 12,000 cubic inches (196.7 L). In some or other such method embodiments, the sealed metal chamber, upon transitioning to a gaseous state, increases the volume of the sealed metal chamber by at least about 50 percent.

In some such above-described method embodiments, the material situated inside the sealed metal chamber is, in its condensed state, in a form selected from the group consisting of liquid, solid, and any mixture thereof. In some such method embodiments, the material situated inside the sealed metal chamber is selected from the group consisting of water, alcohols, glycols, glycerin, phase change materials, eutectics, and combinations thereof.

In some such above-described method embodiments, the annular obstruction reduces flow in at least some regions of the annulus from at least about 20 percent to at most about 100 percent, i.e., complete annular obstruction or isolation for one or more annular regions. In some or other such embodiments, the annular obstruction reduces flow in such annular regions from at least about 40 percent to at most about 100 percent.

In some such above-described method embodiments, the means of heating the condensed material involves injection of a heated fluid into the well. This fluid may be heated at the surface prior to injection, and/or it can be additionally or alternatively heated subsurface via one or more of a variety of subsurface heating means. Additional heating subsurface, with strategically-positioned heaters or other heating means, can impart additional control over the temporal actuation of the annular obstruction device(s). As mentioned above, particularly for the case of steam injection wells used for enhanced oil recovery, in some such method embodiments the means of heating the condensed material involves injecting steam into the well.

In some such above-described method embodiments, the means of heating the condensed fluid makes use of conventional heating means known to persons skilled in the art. In some or other method embodiments, such heating means an additionally or alternatively make use of radiative heating means (e.g., microwave or radiofrequency (RF) heating) and/or chemical heating means (e.g., an exothermic chemical reaction).

In some such above-described method embodiments, such methods further comprise the use of multiple modified lengths of at least partially permeable liner string, so as to effect multiple annular obstructions in multiple regions of the wellbore. An exemplary such embodiment is shown in FIG. 1, where four such annular obstruction devices (124, 126, 130, and 134) are shown.

5. Systems of a Second Type

As mentioned previously herein, systems and methods of the present invention, for initiating annular obstruction in subsurface wells, can be broadly categorized into one of two types—depending on the type of mechanism by which annular obstruction is actuated or otherwise initiated. The discussion that follows, i.e., the discussion within this section, is directed at systems (i.e., systems of a second type) that employ a mechanism that is based, in large part, on the expansion of a metal mesh material that is functionally-associated with a coiled spring that is initially (i.e., before metal mesh expansion) in a load-bearing state.

The above-mentioned mechanism (or means) employed by the above-mentioned systems (of a second type) is afforded by annular obstruction devices (e.g., devices 124, 126, 130, and 134, as depicted in FIG. 1), wherein such devices are said to be coiled spring-based. This type of mechanism or means is mechanistically different from that employed in systems of a first type that utilize a chamber-based annular obstruction mechanism.

With reference to FIGS. 5A, 5B, 6A, and 6B, and with continued reference to FIG. 1 (for exemplary system component correlation), in some embodiments the present invention is directed to a system (or systems) for initiating annular obstruction in a subsurface well 110, said system comprising: (a) an at least partially permeable liner string 120 (comprised of multiple liner joints or segments) situated within a portion of a wellbore (e.g., of subsurface well 110) that is at least partially open (e.g., region 184) to a hydrocarbon-bearing formation; (b) a load-bearing coiled spring (501, 601) disposed about a portion (e.g., a joint or pipe segment) of the at least partially permeable liner string 202, wherein the load-bearing coiled spring is in a load-bearing state selected from the group consisting of a tensioned state (e.g., coiled spring 501) and a compressed state (e.g., coiled spring 601); (c) a spring retainer device (503, 603) attached to the load-bearing coiled spring so as to maintain it in a load-bearing state, wherein the spring retainer device is at least partially fabricated of material designed to melt (or otherwise lose its mechanical integrity) above a predetermined temperature, and wherein upon melting (e.g., melted retainer devices 505 and 605) loses its ability to maintain the coiled spring in a load-bearing state; and (d) metal mesh (506, 606) interposed with the load-bearing spring such that removal of the load from the spring causes the metal mesh to engage the formation (along open borehole wall 123), thereby forming an annular obstruction (e.g., 124, 126, 130, and/or 134) between the liner string 120 and the formation (any of regions 125, 135, 145, and 155), wherein the load removal is effected by application of heat to the annular region sufficient to melt at least a portion of the spring retainer device.

In some such above-described system embodiments, the subsurface well 110 is a steam injection well. While such systems are directed to generating annular obstruction/isolation in subsurface wells in general, steam injection is a economical and efficient method for additionally serving (in addition to its primary enhanced oil recovery purpose) as a means of heating, capable of melting the spring retainer device and effecting a change in the coiled spring from a load-bearing state to a non-load-bearing state, and thereby causing the metal mesh to engage the formation so as to provide annular obstruction (vide infra).

In some such above-described system embodiments, the well 110 is a deviated well, or at least includes sections that are deviated from vertical (i.e., the vertical axis made with the plane of the surface). The well of FIG. 1, i.e., subsurface well 110, is depicted as a deviated well, wherein a significant portion of the open hole region of the well runs in a substantially horizontal direction through much of the formation. Such horizontal wells are common in steam flooding activities for enhanced oil recovery.

In some such above-described system embodiments, the at least partially permeable liner string comprises pores of a type selected from the group consisting of pre-drilled holes, slots, screens, and combinations thereof. In FIG. 1, liner string 120 comprises pores 128, 142 depicted as pre-drilled holes. The term, "pore," as used herein, is not particularly limiting, and can be deemed to be an orifice or, more generally, an opening.

Figure 5A:
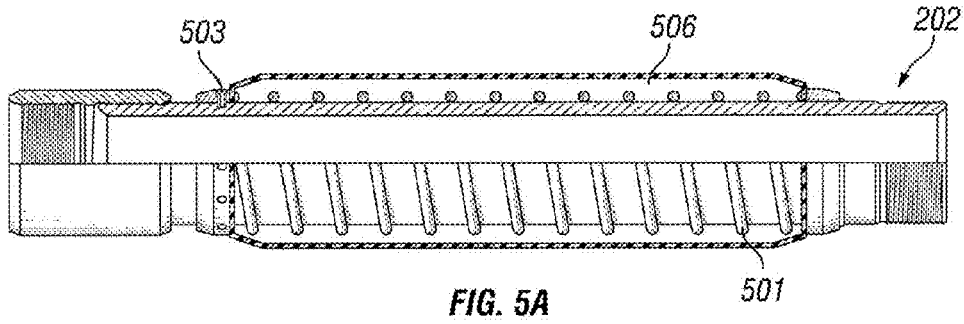
FIG. 5A depicts an annular obstruction means for use in some system and method embodiments (of a second type) of the present invention, wherein the load-bearing coiled spring, about which metal mesh is interposed, is in a tensioned or expanded state.
Figure 5B:
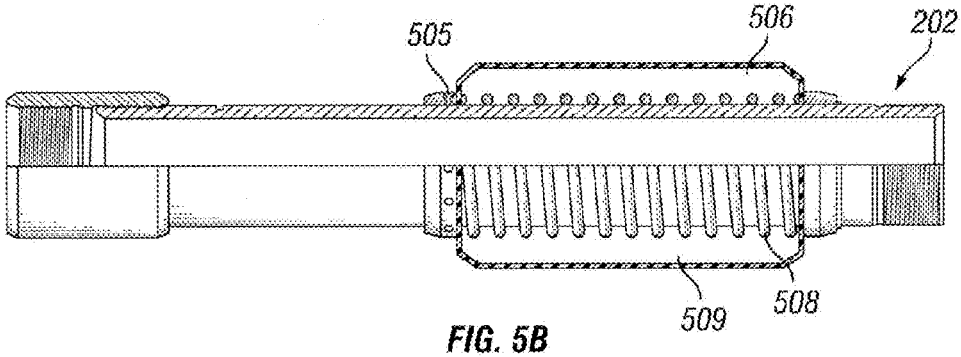
FIG. 5B depicts the obstruction means of FIG. 5A, but in its non-load-bearing state, where the metal mesh interposed therewith has expanded so as to engage the formation and thereby impart annular obstruction.
Figure 6A:
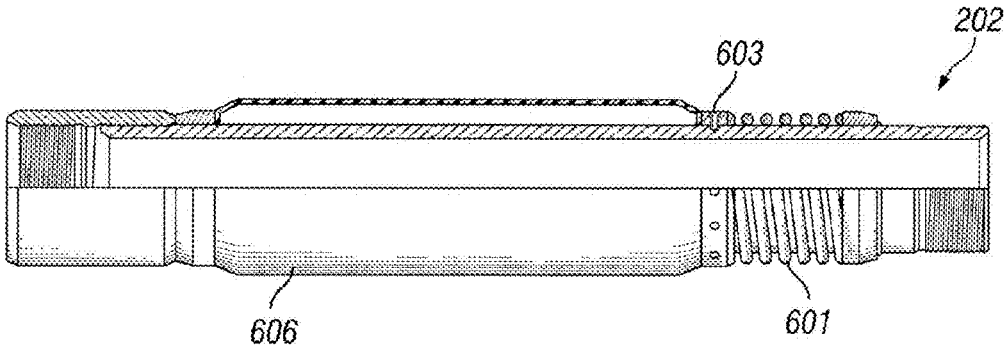
FIG. 6A depicts an annular obstruction means for use in some system and method embodiments (also of a second type) of the present invention, wherein the load-bearing coiled spring, functionally-associated with a network of metal mesh, is in a compressed state.
Figure 6B:
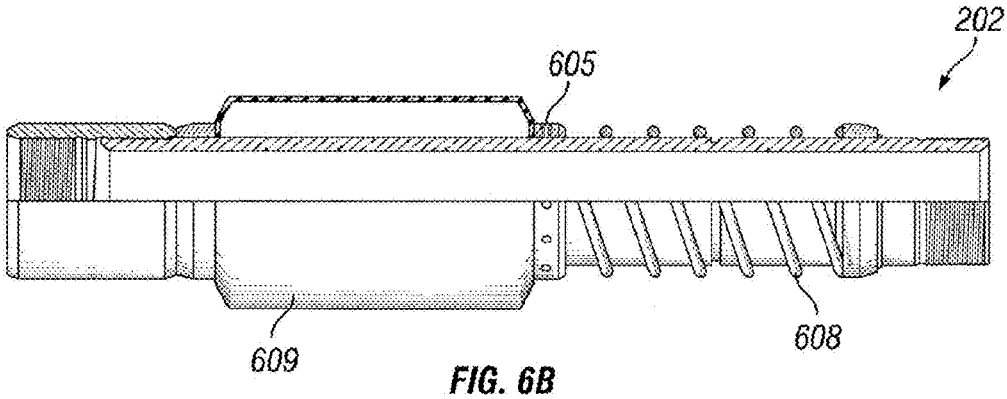
FIG. 6B depicts the obstruction means of FIG. 6A, but in its non-load-bearing state, where the metal mesh functionally-associated with the coiled spring has expanded so as to engage the formation and thereby impart annular obstruction.

In some such above-described system embodiments, the coiled spring is tensioned with a load of at least about 50 $lb_f$ (pound-force) (222 N) (e.g., tensioned coiled spring 501, as shown in FIG. 5A). In some additional or alternative such system embodiments, the coiled spring is compressed with a load of at least about 50 $lb_f$ (222 N) (e.g., compressed coiled spring 601, as shown in FIG. 6A). Note that the nature of the load (tension or compression) can have implications for the manner in which the metal mesh is functionally-associated with the load-bearing coiled spring (vide infra).

In some such above-described system embodiments, the spring retainer device (e.g., 503, 603) is attached to at least one end of the load-bearing coiled spring. Wherein the spring retainer device anchors only a single end of the load-bearing coiled spring, it is contemplated that in such embodiments, the other end is affixed or made to otherwise adhere to the liner string about which it is disposed (such embodiments are depicted in FIGS. 5 and 6). In some or other embodiments, both ends of the load-bearing coiled spring are anchored to the liner string via meltable spring retainer devices, wherein the coiled spring floats freely about the liner string upon removal of the load.

Generally, the spring retainer device of the above-described system embodiments should respond to thermal energy in such a manner that at some particular temperature, the mechanical integrity of the device (or a portion thereof) is compromised in such a way as to render the device incapable of retaining the coiled spring in a load-bearing state, wherein the loss of mechanical integrity of the spring retainer device is thermally-induced. In some such above-described system embodiments, at least the meltable portion of the spring retainer device is fabricated of a thermoplastic polymeric material, i.e., a plastic material with a glass transition temperature (as opposed to a thermoset material that merely decomposes) that "melts" at a particular temperature or over a particular range of temperatures. Suitable such thermoplastic polymeric material can include, but is not limited to, polyethylene, polypropylene, acrylic, polyvinylidene chloride, blends and combinations thereof, and the like.

In some such above-described system embodiments, the metal mesh comprises a woven metal mesh. In some or other such embodiments, the metal mesh comprises a sintered metal mesh. In some or other such embodiments, the metal mesh comprises rolled metal fibers. In some or still other embodiments, the metal mesh may be impregnated with materials such as, for example, thermosetting polymers, such materials being operable for enhancing the annular obstruction. The metal mesh can be of a variety of gauges, but it is preferable that the gauge be chosen with consideration given to the coiled spring characteristics so that they can operate in optimal concert to effectively induce annular obstruction. Additionally, in some or other such embodiments, a protective covering can be utilized to prevent damage to the metal mesh while it is being deployed in the well. A suitable such covering may be comprised of a thermoplastic material.

Similar to systems of a first type, in some such above-described system embodiments (i.e., systems of a second type), the annular obstruction reduces flow in the annulus (or in at least one or more regions thereof) by at least about 20 percent to at most about 100 percent. In some other such embodiments, the annular obstruction reduces flow in the annulus by at least about 20 percent to at most about 90 percent. In some or still other embodiments, the annular obstruction reduces flow in the annulus by at least about 40 percent to at most about 90 percent. While not intending to be bound by theory, complete annular obstruction (i.e., annular isolation) is generally more difficult to achieve with the coiled spring-based annular obstruction device(s) (that are generally part of systems of a second type) than with the chamber-based devices of systems of a first type.

In some such above-described system embodiments, the heat applied to the annular region to melt the spring retainer device (or a portion thereof) is provided by the injection of a heated fluid into the well. In some such system embodiments, the heated fluid is steam—fortuitous in the case of steam injection wells, in that the steam can serve a dual purpose. Other heated fluids and/or heating means (e.g., chemical, radiative), on the surface and/or downhole, can be additionally or alternatively employed to melt the spring retainer device(s) mentioned above.

In some such above-described system embodiments, such systems can further comprise one or more additional load-bearing springs, spring retainer devices, and metal mesh, so as to effect multiple annular obstructions in the wellbore. Such an embodiment may be seen to be illustrated in FIG. 1, wherein four such annular obstruction devices (e.g., coiled spring-based such devices of systems/methods of a second type) are depicted in the figure as devices 124, 126, 130, and 134.

6. Methods of a Second Type

Method embodiments (of a second type) described in this section generally correspond in a substantial manner with the system embodiments (of a second type) described above in Section 5. Accordingly, reference will continue to be made, in exemplary fashion, to FIGS. 1, 5A, 5B, 6A, and 6B, as many of the details are common to both the system and method. Generally, such methods make use of annular obstruction devices (e.g., 124, 126, 130, and 134, as depicted in FIG. 1) that employ a coiled spring mechanism, i.e., coiled spring-based annular obstruction devices.

Figure 7:
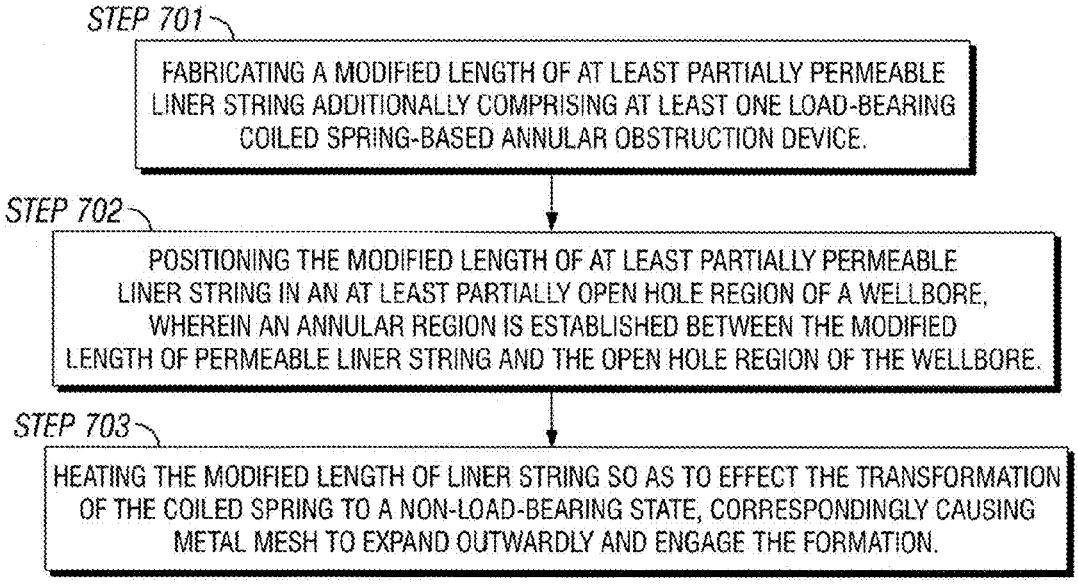
FIG. 7 outlines, in flow diagram form, methods of a second type for initiating annular obstruction in a subsurface well, in accordance with some embodiments of the present invention.

Referring now to FIG. 7, in some embodiments, the present invention is directed to a method for initiating annular obstruction in a subsurface well, said method comprising: (Step 701) fabricating an at least partially permeable length of modified liner string, the length of modified liner string comprising: (i) a load-bearing coiled spring disposed about at least a portion of the modified liner string, wherein the load-bearing coiled spring is in a load-bearing state selected from the group consisting of a tensioned state and a compressed state; (ii) a spring retainer device attached to the load-bearing coiled spring so as to maintain it in the load-bearing state, wherein the spring retainer device is at least partially fabricated of material designed to melt above a predetermined temperature, and wherein upon melting loses its ability to maintain the coiled spring in a load-bearing state; and (iii) metal mesh interposed with the load-bearing coiled spring such that when the coiled spring undergoes a transformation from a load-bearing state to a non-load-bearing state, the metal mesh expands outward in a radial direction; (Step 702) positioning the modified length of modified liner string in an open hole region of a wellbore, wherein an annular region is established between the modified length of liner string and the open hole region of the wellbore; and (Step 703) heating the modified length of liner string so as to melt the spring retainer device and effect the transformation of the coiled spring to the non-load-bearing state, correspondingly causing the metal mesh to expand outwardly and engage the formation, thereby forming an annular obstruction between the modified length of liner string and the open hole.

As in the case of the analogous system embodiments (of a second type) described above, in some such above-described method embodiments (of a second type), the subsurface well is a steam injection well. In some such embodiments, the steam injected into the subsurface (in an effort to enhance oil recovery) can further serve as a means by which the modified length of liner string can be heated so as to effect the melting of (or loss of integrity in) the spring retainer device, which in turn effects the transition of the coiled spring from a load-bearing state to a non-load-bearing state.

Corresponding to the analogous system embodiments described in Section 5 above, in some such above-described method embodiments, the subsurface well is a deviated well. Generally speaking, a well is deemed to be "deviated" if a substantial part of the wellbore deviates from a vertical axis established with the surface. Note that such deviation is typically intentional (e.g., directional drilling); and while some such subsurface wells so formed are largely horizontal (common for steam injection wells), the wells used in conjunction with at least some methods and/or system embodiments of the present invention are not required to be of the deviated variety.

Corresponding to the analogous system embodiments above, in some such above-described method embodiments (i.e., of a second type), the at least partially permeable liner string comprises pores (openings) of a type selected from the group consisting of pre-drilled holes, slots, screens, and combinations thereof Characterization and variation among such pores is as described above in the analogous system embodiments.

In some such above-described method embodiments (of a second type), the load-bearing coiled spring is tensioned with a load of at least 50 $lb_f$ (222 N). In other such above-described method embodiments, the load-bearing coiled spring is compressed with a load of at least 50 $lb_f$ (222 N). In either case (tensioned or compressed), in some such embodiments the load imparted to the spring may well dictate the type and characteristics of the coiled spring so employed (or vice versa). Additionally, in some embodiments, the type and characteristics of the coiled spring may well dictate the type and characteristics of the metal mesh used in combination with the coiled spring, wherein a synergistic balance is desired so as to effect optimal annular obstruction (vide infra).

In some such above-described method embodiments, the spring retainer device (503, 603) is attached to at least one end of the load-bearing coiled spring. Wherein the spring retainer device anchors only a single end of the load-bearing coiled spring, it is contemplated that in such embodiments, the other end is affixed or made to otherwise adhere to the liner string about which it is disposed (such embodiments are depicted in FIGS. 5 and 6. In some or other embodiments, both ends of the load-bearing coiled spring are anchored to the liner string via meltable spring retainer devices, wherein the coiled spring free-floats about the liner string subsequent to load removal.

Generally, the spring retainer device of the above-described method embodiments should respond to heat (i.e., thermal energy) in such a manner that at some particular temperature (or particular range of temperatures), the mechanical integrity of the device (or a portion thereof) is compromised in such a way as to render the device incapable of retaining (or maintaining) the coiled spring in a load-bearing state, wherein the loss of mechanical integrity of the spring retainer device is thermally-induced. In some such above-described method embodiments, at least the meltable portion of the spring retainer device is fabricated of a thermoplastic ("meltable") polymeric material, i.e., a plastic material with a glass transition temperature (as opposed to a thermoset material that merely decomposes). Suitable such thermoplastic polymeric material can include, but is not limited to, polyethylene, polypropylene, acrylic, polyvinylidene chloride, blends and combinations thereof, and the like.

In some such above-described method embodiments, the metal mesh comprises a woven metal mesh. In some or other such embodiments, the metal mesh comprises a sintered metal mesh. In some or other such embodiments, the metal mesh comprises rolled metal fibers. In some or still other embodiments, the metal mesh may be impregnated with materials such as, for example, thermosetting polymers, such materials being operable for enhancing the annular obstruction. The metal mesh can be of a variety of gauges, but it is preferable that the gauge be chosen with consideration given to the coiled spring characteristics so that they can operate in optimal concert to effectively induce annular obstruction. Additionally, in some or other such embodiments, a protective covering can be utilized to prevent damage to the metal mesh while it is being deployed in the well. A suitable such covering may be comprised of a thermoplastic material.

In some such above-described method embodiments, the annular obstruction reduces flow in at least some regions of the annulus from at least about 20 percent to at most about 100 percent, i.e., complete annular obstruction or isolation for one or more annular regions. In some or other such embodiments, the annular obstruction reduces flow in such annular regions from at least about 40 percent to at most about 100 percent.

As mentioned above for the corresponding system embodiments (of a second type), and while not intending to be bound by theory, complete annular obstruction (i.e., annular isolation) is likely to be less frequently achieved using the coiled spring-based annular obstruction device(s) of methods of the second type—in relation to methods of a first type utilizing chamber-based annular obstruction device(s).

In some such above-described method embodiments, the heat applied to the annular region to melt the spring retainer device is provided by steam injection. Additional heating subsurface, with strategically-positioned heaters or other heating means, can impart additional control over the temporal actuation of the annular obstruction device(s). As mentioned above, particularly for the case of steam injection wells used for enhanced oil recovery, in some such method embodiments the means of heating the condensed material involves injecting steam into the well.

In some such above-described method embodiments, the application of heat (i.e., heating) makes use of conventional heating means known to persons skilled in the art. In some or other method embodiments, such heating means can additionally or alternatively make use of radiative heating means (e.g., microwave or radiofrequency (RF) heating) and/or chemical heating means (e.g., an exothermic chemical reaction).

In some such above-described method embodiments (of a second type), such methods further comprise the use of multiple modified lengths of modified liner string, as multiple joints within an overall liner string assembly, so as to effect multiple annular obstructions in multiple regions of the wellbore. An exemplary such embodiment is shown in FIG. 1, where four such annular obstruction devices (124, 126, 130, and 134) are shown.

7. Variations

Variational embodiments of the above-described systems and methods include systems and/or methods of a first type incorporating elements of systems and/or methods of a second type (or vice versa). For example, and with reference to the exemplary system configuration of FIG. 1, annular obstruction devices 124 and 126 could be based on the sealed metal chamber (systems/methods of a first type), whereas annular obstruction devices 130 and 134 could be based on the coiled spring (systems/methods of a second type). Such embodiments are deemed hybrid systems (with corresponding hybrid methods) of the present invention for inducing annular obstruction in a subsurface well.

Variational embodiments also include systems and methods incorporating a plurality of any of the above-described annular obstruction devices (chamber- and/or coiled spring-based) that are designed or engineered to actuate at different temperatures. Proper such design can be seen to significantly advance the extent to which such a system can be controlled via "hybrid" means (vide supra).

Other presently-contemplated variations include, but are not limited to, the use of different heating means and/or different heating fluids within the same well, the former with different types of systems (i.e., hybrid systems), and either or both of the former used together to generate a super system comprising a plurality of any of such systems in a plurality of such wells to stimulate hydrocarbon resources in a common reservoir. Additionally or alternatively, any of such systems can be used in subsurface wells other than previously described and/or in collective or concerted fashion among two or more wells of differing type.

8. Summary

As described throughout, the present invention is directed to systems and methods for initiating annular obstructions in subsurface wells largely used in, or in support of, enhanced oil recovery operations—particularly enhanced oil recovery efforts involving steam injection (e.g., steam flooding). In at least some instances, system and method embodiments of the present invention utilize one or more passively-activated/actuated devices (or hybrid variants thereof) for inducing annular obstruction, wherein the associated passive activation/actuation is at least partially controlled by thermal means such that it can be deemed to be thermally-directed. Such thermally-directed passive activation can afford considerably more control over the annular obstruction process (hence the term, "hybrid activation/actuation") and, correspondingly, over the overall steam injection into the formation and associated reservoir—thereby providing more efficient recovery.

All patents and publications referenced herein are hereby incorporated by reference to the extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A system for initiating annular obstruction in a subsurface well, said system comprising:

a) an at least partially permeable liner string situated within a portion of a wellbore that is at least partially open to a hydrocarbon-bearing formation;

b) a load-bearing coiled spring disposed about a portion of the at least partially permeable liner string, wherein the load-bearing coiled spring is in a load-bearing state selected from the group consisting of a tensioned state and a compressed state;

c) a spring retainer device attached to the load-bearing coiled spring so as to maintain the load bearing coiled spring in a load-bearing state, wherein the spring retainer device is at least partially fabricated of material designed to melt above a predetermined temperature, and wherein upon melting the spring retainer device loses the ability to maintain the load bearing coiled spring in a load-bearing state; and d) metal mesh interposed with the load-bearing coiled spring such that removal of the load from the load bearing coiled spring causes the metal mesh to engage the formation, thereby forming an annular obstruction between the liner string and the formation, wherein the load removal is effected by application of heat to the annular region sufficient to melt at least a portion of the spring retainer device.

2. The system of claim 1, wherein the subsurface well is a steam injection well.

3. The system of claim 1, wherein the subsurface well is a deviated well.

4. The system of claim 1, wherein the at least partially permeable liner string comprises pores of a type selected from the group consisting of pre-drilled holes, slots, screens, and combinations thereof.

5. The system of claim 1, wherein the coiled spring is tensioned with a load of at least about 50 $lb_f$.

6. The system of claim 1, wherein the coiled spring is compressed with a load of at least about 50 $lb_f$.

7. The system of claim 1, wherein the spring retainer device is attached to at, least one end of the load-bearing coiled spring.

8. The system of claim 1, wherein at least the meltable portion of the spring retainer device is fabricated of a thermoplastic polymeric material.

9. The system of claim 8, wherein the thermoplastic polymeric material is selected from the group consisting of polyethylene, polypropylene, acrylic, polyvinylidene chloride, and combinations thereof.

10. The system of claim 1, wherein the metal mesh comprises material selected from the group consisting of woven metal mesh, sintered metal mesh, rolled metal fibers, and combinations thereof.

11. The system of claim 1, wherein the annular obstruction reduces flow in the annulus by at least about 20 percent and at most about 100 percent.

12. The system of claim 1, wherein the heat applied to the annular region to melt the spring retainer device is provided by steam injection.

13. The system of claim 1, further comprising one or more additional load-bearing springs, spring retainer devices, and metal mesh, so as to effect multiple annular obstructions in the wellbore.

14. A method for initiating annular obstruction in a subsurface well, said method comprising:

a) fabricating an at least partially permeable length of modified liner string, the length of modified liner string comprising:

i) a load-bearing coiled spring disposed about at least a portion of the modified liner string, wherein the load-bearing coiled spring is in a load-bearing state selected from the group consisting of a tensioned state and a compressed state;

ii) a spring retainer device attached to the load-bearing coiled spring so as to maintain the load bearing coiled spring in the load-bearing state, wherein the spring retainer device is at least partially fabricated of material designed to melt above a predetermined temperature, and wherein upon melting the spring retainer device loses the ability to maintain the coiled spring in a load-bearing state; and iii) metal mesh interposed with the load-bearing coiled spring such that when the load bearing coiled spring undergoes a transformation from a load-bearing state to a non-load-bearing state, the metal mesh expands outward in a radial direction;

b) positioning the modified length of modified liner string in an open hole region of a wellbore, wherein an annular region is established between the modified length of liner string and the open hole region of the wellbore; and c) heating the modified length of liner string so as to melt the spring retainer device and effect the transformation of the coiled spring to the non-load-bearing state, correspondingly causing the metal mesh to expand outwardly and engage the formation, thereby forming an annular obstruction between the modified length of liner string and the open hole.

15. The method of claim 14, wherein the subsurface well is a steam injection well.

16. The method of claim 14, wherein the subsurface well is a deviated well.

17. The method of claim 14, wherein the modified length of liner string comprises pores of a type selected from the group consisting of pre-drilled holes, slots, screens, and combinations thereof.

18. The method of claim 14, wherein the load-bearing coiled spring is tensioned with a load of at least 50 $lb_f$.

19. The method of claim 14, wherein the load-bearing coiled spring is compressed with a load of at least 50 $lb_f$.

20. The method of claim 14, wherein the spring retainer device is attached to at least one end of the load-bearing coiled spring.

21. The method of claim 14, wherein at least the meltable portion of the spring retainer device is fabricated of a thermoplastic polymeric material.

22. The method of claim 14, wherein the metal mesh comprises a woven metal mesh.

23. The method of claim 14, wherein the annular obstruction reduces flow in the annulus by at least about 20 percent and at most about 100 percent.

24. The method of claim 14, wherein the heat applied to the annular region to melt the spring retainer device is provided by steam injection.

25. The method of claim 14, further comprising the use of multiple modified lengths of modified liner string, as multiple joints within an overall liner string assembly, so as to effect multiple annular obstructions in multiple regions of the wellbore.

* * * * *